US006230796B1

(12) United States Patent
Tovar De Pablos

(10) Patent No.: US 6,230,796 B1
(45) Date of Patent: May 15, 2001

(54) SYSTEM AND DEVICE FOR OPTIMIZING USE AND INSTALLATION OF AUXILIARY EQUIPMENT FOR DOWN HOLE OPERATIONS IN WELLS

(76) Inventor: Juan José Tovar De Pablos, 7 rue Islaw Terrace, Aberdeen (GB), AV10 1XE ( * ) Notice: Subject to any disclaimer, the term of this patent is extended or adjusted under 35 U.S.C. 154(b) by 0 days.

(21) Appl. No.: 09/416,465

(22) Filed: Oct. 12, 1999

(51) Int. Cl.[7] ..... E21B 23/01; E21B 23/04
(52) U.S. Cl. ..... 166/66.5; 166/212; 166/241.6
(58) Field of Search ..... 166/66.5, 206, 166/212, 241.1, 241.2, 241.4, 241.6

(56) References Cited

U.S. PATENT DOCUMENTS

| | | | | |
|---|---|---|---|---|
| Re. 30,988 | * | 7/1982 | Crickmer | 166/66.5 X |
| 2,153,787 | * | 4/1939 | Anderson | 166/241.4 |
| 2,830,663 | * | 4/1958 | Kirby, II | 166/66.5 |
| 3,086,589 | * | 4/1963 | McGowen, Jr. | 166/66.5 X |
| 3,637,033 | * | 1/1972 | Mayall | 166/66.5 X |
| 4,113,611 | * | 9/1978 | Gohm | 166/66.5 X |
| 4,438,810 | * | 3/1984 | Wilkinson | 166/66.5 |
| 4,687,054 | * | 8/1987 | Russell et al. | 166/66.5 X |
| 5,024,271 | * | 6/1991 | Meihua | 166/66.5 |
| 5,435,351 | | 7/1995 | Head . | |
| 6,012,521 | * | 1/2000 | Zunkel et al. | 166/66.5 X |

* cited by examiner

*Primary Examiner*—George Suchfield
(74) *Attorney, Agent, or Firm*—Brown, Martin, Haller & McClain LLP

(57) ABSTRACT

A system for optimizing the use of auxiliary equipment for down hole operations in wells includes an elongated housing for mounting in a metallic pipe, a plurality of retractable elements mounted on the outer surface of the housing and movable between an extended position projecting outwardly from the outer surface to space the surface from an inner wall of the pipe, and a retracted position, and at least one permanent magnet on the outer surface of the housing which is attracted to the inner wall of the metallic pipe. The housing is moved closer to the inner wall of the pipe when the retractable elements are retracted by the pressure of fluid in the pipe, due to the magnetic attraction between the magnet and pipe wall, resisting movement of the pipe.

8 Claims, 1 Drawing Sheet

SYSTEM AND DEVICE FOR OPTIMIZING USE AND INSTALLATION OF AUXILIARY EQUIPMENT FOR DOWN HOLE OPERATIONS IN WELLS

BACKGROUND OF THE INVENTION

1. Field of the Invention

The present invention refers to a technique for optimizing the installation, use and operation down hole of auxiliary equipment employed during the production of fluids from subsurface reservoirs.

2. Summary of Prior Art

It is a common practice in the oil and gas industry to optimize the use of auxiliary equipment in well bores using metallic pipes. These devices are inserted into the pipes and used to provide energy, register and/or acquire data or manipulate and activate equipment and systems in the well bores. It is also known that these devices have limited mechanical resistance therefore, the weight of these devices, acting on their cross-sectional area, creates stresses that are higher than their inherent mechanical resistance. It is therefore necessary to distribute their total weight in limited sections. The partial weight of these sections must be loaded onto an internal section of the metallic pipe and throughout the required length.

The operation of inserting the total length of these devices into the metallic pipe is carried out by extending its length onto a surface and then inserting the auxiliary equipment and devices. The devices are inserted from one side of the metallic pipe by the use of cables or tubes that are pulled from the other side. In order to overcome the mechanical limitations imposed by the limited mechanical strength of the devices, a mechanism that takes the weight of the devices when in the vertical position in the well bore is attached.

When the installation of the devices through its entire length in the internals of the metallic pipe is completed, including the load bearing mechanisms attached to the devices, the metallic pipe is then spooled onto a reel of large diameter for eventual utilization in the well bores. The problem to be resolved is unloading the weight of the devices to the internal walls of the metallic pipe for each particular section and through the entire length of the metallic pipe. This is achieved at the end of the inserting process when all the suspending mechanisms are placed into the pipe; they must be activated simultaneously.

U.S. Pat. No. 5,435,351 discloses anchoring mechanisms that are activated by mechanical forces and by chemical action provided by purpose made fluids introduced into the metallic pipe. The use of chemicals is problematic because in most cases they are of a corrosive nature. The actuation and release of each anchoring mechanism that is gripping the internal walls of the metallic pipe is also very complex and difficult to achieve. Additionally, this gripping action creates damaging indentations and deformation onto the walls of the metallic pipe that can lead to a failure.

SUMMARY OF THE INVENTION

It is an object of the present invention to provide a new and improved system or apparatus for optimizing the use of auxiliary equipment in down hole operations in wells.

According to the present invention, an apparatus for optimizing the use of auxiliary equipment in down hole operations in wells is provided, which comprises a housing for introduction inside a metallic pipe, the housing having an outer surface spaced from the inner wall of the pipe, a plurality of retractable elements mounted on the outer surface of the housing, and a plurality of permanent magnets also mounted on the outer surface of the housing, the retractable elements being movable between an extended position for engagement with the inner wall of the pipe to space the magnets from the pipe, and a retracted position allowing the permanent magnets to move the housing closer to the pipe.

When fluid is present in the pipe, fluid pressure will urge the retractable elements into the retracted position, allowing the permanent magnets to get closer to the inner wall of the pipe. The increased magnetic attraction between the magnets and pipe will limit axial movement of the housing. A reduction or removal of fluid pressure will allow the retractable elements to move outwardly, spacing the magnets away from the inner wall of the pipe and facilitating retrieval of devices mounted in the housing from the pipe. The retractable elements may be biased outwardly by any suitable means, and may be of resiliently compressible material, for example, or may be biased outwardly by springs or the like.

The solution offered by the present invention resolves the problems described previously in a safe, effective and economic manner. It also allows more flexibility during installation of the devices into the metallic pipe.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

FIGS. 1–9 illustrate a device or apparatus according to a preferred embodiment of the present invention for optimizing use and installation of auxiliary equipment for down hole operations in wells. The apparatus basically comprises a housing or arcuate member 1 of predetermined length having a series of spaced, longitudinally extending slots or grooves 3 extending along its length but terminating short of its opposite ends, and a pair of spaced, round seats 2 adjacent each end of housing 1.

Figure 1:
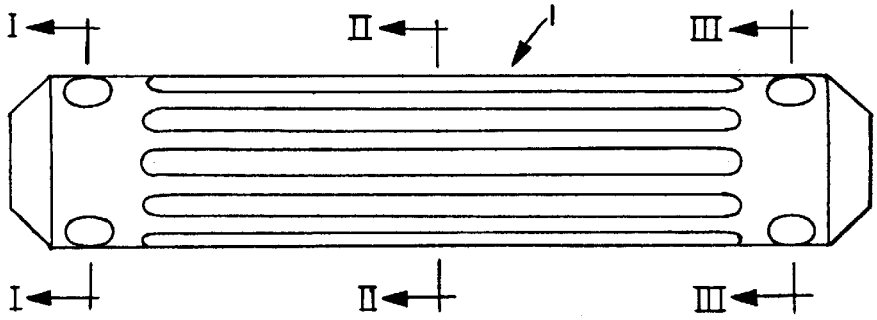
FIG. 1 is a side view of an apparatus according to a preferred embodiment of the present invention, with the retractable elements and permanent magnets removed, for installation at particular points through the length of auxiliary devices or equipment prior to insertion into a metallic pipe.
Figure 2:
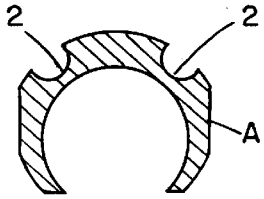
FIG. 2 is a cross-section on the lines I—I of FIG. 1, illustrating the seats for the retractable elements.
Figure 3:
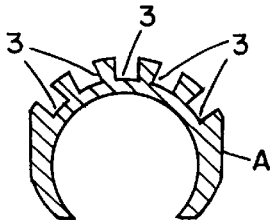
FIG. 3 is a cross-section on the line II—II of FIG. 1, showing the permanent magnet's seat.
Figure 4:
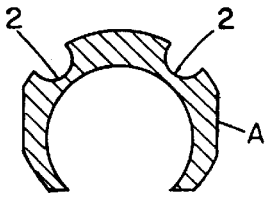
FIG. 4 is a cross-section on the line III—III of FIG. 1, illustrating the seats for the retractable elements.
Figure 5:
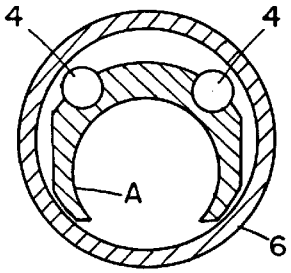
FIG. 5 is a cross-section similar to FIG. 2 illustrating the housing of FIG. 1 inserted into the metallic pipe with retractable elements mounted in the housing seats.
Figure 6:
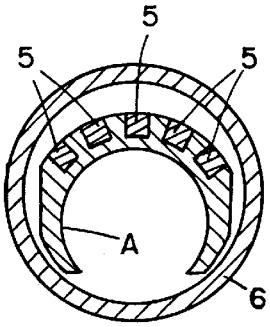
FIG. 6 is a cross-section similar to FIG. 3 but with the housing installed into the pipe as in FIG. 5 and permanent magnets secured in the housing grooves and kept at a distance from the internal walls of the metallic pipe by the retractable elements.
Figure 7:
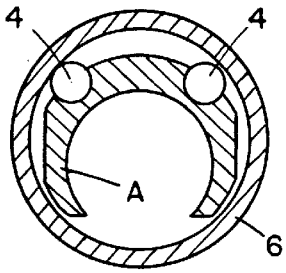
FIG. 7 is a cross-section similar to FIG. 4 but with the retractable elements installed and the housing inserted in a metallic pipe as in FIGS. 5 and 6.

A generally round element 4 is mounted in each of the seats, and each element projects partially out of the seat when in an unstressed condition, as illustrated in FIGS. 5 and 7. The elements 4 may be of a compressible or resilient material, or may be collapsible void spheres or the like, so that they are movable between the unstressed, extended position of FIGS. 5 and 7 into the compressed, retracted position of FIGS. 8 and 10 in which they are completely within the respective seats. A series of linear, permanent magnets 5 are suitably mounted in the respective slots or grooves 3, as best illustrated in FIG. 6.

The attachment of the housing onto an auxiliary device can be made using different methods. The figures do not present any kind of equipment and systems to be activated by the auxiliary devices since they can be of various types and forms depending on the technology.

Figure 8:
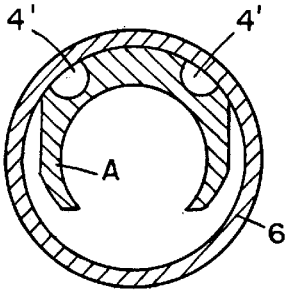
FIGS. 8 and 10 illustrate the retracted position of the retractable elements of FIGS. 5 and 7.
Figure 9:
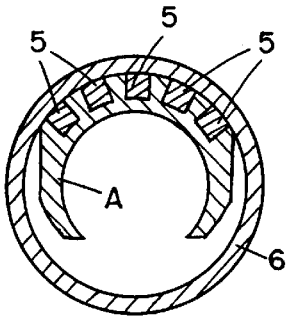
FIG. 9 is a cross-section similar to FIG. 6 but illustrating the position of the permanent magnets closer to the internal walls of the metallic pipe when the retractable elements are in the retracted position of FIGS. 8 and 10.
Figure 10:
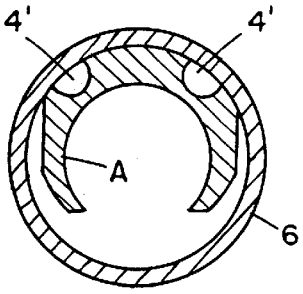

A number of housings or members 1 carrying auxiliary devices will be inserted into a metallic pipe 6 at predetermined distances from each other. The apparatus works automatically to secure the housings 1 to the pipe when fluid is present in the pipe, and to release the housing on reduction or removal of fluid pressure. It is sufficient to pressurize the fluid present in the metallic pipe 6 to obtain a simultaneous reduction on the weight and loading across the entire length of the auxiliary devices inside the metallic pipe. In fact, the pressure exerted by the fluid in the metallic tube 6 induces the retractable elements 4 to adopt a retracted position 4' as illustrated in FIGS. 8 and 10, allowing the permanent magnets 5 to get closer to the internal walls of the metallic pipe 6. The increase in the attraction force between the permanent magnets 5 and the metallic pipe 6 bear some of the weight of the device attached to the housing, limiting its axial movement. A reduction or removal of the pressure exerted by the fluid inside the metallic pipe 6 will allow the elements 4 to return to the extended position of FIGS. 5 and 7, and distance the permanent magnets 5 from the internal walls of the metallic pipe 6. This will facilitate the retrieval of the devices with the housings from the metallic pipe 6.

An advantage to the round shape of the elements 4 is that they can roll in their respective seats 2, improving the ability of the housing 1 to move inside the metallic pipe. Elements 4 are retained in their seats by the edges of seats 2, while still being permitted to roll in the seat.

Although a preferred embodiment of the invention has been described above by way of example only, it will be understood by those skilled in the field that modifications may be made to the disclosed embodiment without departing from the scope of the invention, which is defined by the appended claims.

I claim:

1. A system for optimizing the use of auxiliary equipment for down hole operations in wells, comprising:

an elongated housing for mounting in a metallic pipe, the housing having an outer surface;

a plurality of retractable elements mounted on the outer surface and movable between an extended position projecting outwardly from the outer surface to space the surface from an inner wall of the pipe, and a retracted position; and at least one permanent magnet on the outer surface of the housing which is attracted to the inner wall of the metallic pipe, whereby the housing is moved closer to the inner wall of the pipe when the retractable elements are retracted under the magnetic attraction force between the magnet and pipe wall.

2. The system as claimed in claim 1, wherein the retractable elements are biased into the retracted position by the pressure of fluid in the pipe, and are extended into the extended position on reduction or removal of fluid pressure.

3. The system as claimed in claim 1, including a plurality of permanent magnets mounted on the outer surface of the housing.

4. The system as claimed in claim 1, wherein the housing comprises a generally arcuate member.

5. The system as claimed in claim 1, wherein the housing comprises an elongate member of predetermined length.

6. The system as claimed in claim 5, wherein the housing has opposite ends, at least one seat adjacent each end, each retractable element being mounted in a respective one of the seats, a plurality of linear grooves extending from a location adjacent one of the seats to a location adjacent the other seat at the opposite end of the housing, and an elongate permanent magnet secured in each of the grooves.

7. The system as claimed in claim 1, wherein each retractable element is of compressible material and is of round shape in its extended, uncompressed condition.

8. The system as claimed in claim 7, wherein the outer surface of the housing has a plurality of seats of part spherical shape, and each retractable element is rotatably mounted in a respective one of the seats.

* * * * *